US005546785A

United States Patent [19]

Platt et al.

[11] Patent Number: 5,546,785

[45] Date of Patent: Aug. 20, 1996

[54] CRANK MECHANISM FOR CAN BODY MAKER APPARATUS

[75] Inventors: Grayeme E. Platt, Pine; Robert D. Anderson, Littleton, both of Colo.; P. Michael Mueller, Suwanee, Ga.

[73] Assignee: Aluminum Company of America, Pittsburgh, Pa.

[21] Appl. No.: 435,358

[22] Filed: May 5, 1995

[51] Int. Cl.[6] ..... B21J 9/18

[52] U.S. Cl. ..... 72/450; 72/452.6; 72/347; 100/282; 100/292

[58] Field of Search ..... 72/450, 451, 452.5, 72/452.6, 347; 100/281, 282, 283, 285, 286, 292

[56] References Cited

U.S. PATENT DOCUMENTS

| | | | |
|---|---|---|---|
| 3,696,657 | 10/1972 | Maytag | 72/450 |
| 4,934,167 | 6/1990 | Grims et al. | 72/347 |
| 5,127,256 | 7/1992 | Shiga et al. | 72/452.5 |
| 5,335,532 | 8/1994 | Mueller et al. | 72/450 |

FOREIGN PATENT DOCUMENTS

| | | | |
|---|---|---|---|
| 1810295 | 4/1993 | U.S.S.R. | 100/282 |

*Primary Examiner*—David Jones
*Attorney, Agent, or Firm*—Thomas R. Trempus

[57] ABSTRACT

An improved can body maker apparatus has a drive system for reciprocating a ram. The drive system includes a crank having a first half and a second half, both being adapted for rotational movement about a first axis in the can body maker apparatus. A brake disk is fixedly mounted on the crank first half. A crank arm is mounted on the crank second half. The brake disk and the crank arm define therebetween a second axis. A connecting rod is supported for rotational movement about the second axis. The connecting rod is adapted for mechanical communication with the body maker ram. The brake disk and the crank arm define in combination at least one additional second axis, wherein the rotation of the crank arm about the additional second axis changes the throw of the connecting rod for each revolution of the drive system crank.

17 Claims, 6 Drawing Sheets

CRANK MECHANISM FOR CAN BODY MAKER APPARATUS

FIELD OF THE INVENTION

This invention relates generally to can body makers and more particularly to the main drive system of a can body maker. The improved body maker includes a split crank shaft with a quick change stroke adjustment feature.

BACKGROUND OF THE INVENTION

A conventional can body maker apparatus is disclosed in U.S. Pat. No. 3,696,657, issued to J. H. Maytag and an improvement to the ram assembly of the can body maker ram assembly is disclosed in U.S. Pat. No. 4,934,167, issued to C. M. Grims, et al. Both of these patents are assigned to Adolph Coors Company. The aforedescribed patents are incorporated herein by reference as if fully set forth. The assignee of the instant invention is also the assignee of U.S. Pat. No. 5,335,532, "Improved Body Maker Apparatus," which discloses a counterbalance mass system that facilitates improved speeds and operational efficiencies in can body makers.

Can body makers produce elongated can bodies from shallow metal cups or can shells. The can shells have a wall thickness of approximately 0.009 to 0.012 inch, and the elongated can bodies have a wall thickness reduced to approximately 0.0045 inch. In a conventional can body maker apparatus, a ram is movably mounted for reciprocal, straight line motion at rates sufficient to form from between 180 and 220 can bodies per minute. The ram can be supported for straight line, or X-axis, motion by a mounting structure that incorporates fluid bearing technology. However, because the ram is motivated by the circular motion of a crank assembly, minor elements of both Y-axis and Z-axis motion may be present in the reciprocal motion of the ram. The stroke length, that is the distance traveled by the movable ram, is between about 18 to 26 inches. As a general rule, for a given can body maker, the shorter the ram stroke, the greater the rate or number of cycles per minute at which the ram can be operated. Misalignment as small as between about 0.0005 and 0.0010 inch can result in the formation of defective cans. As can be appreciated, it is an ongoing objective of the can body maker industry to enhance the operation of the ram by minimizing as much as possible, any transient Y or Z axis motion in the ram.

In conjunction with the reciprocal motion of the ram, a redraw sleeve is supported in a redraw assembly. The redraw sleeve engages the shell prior to contact by the ram, applying a restraining force against the shell as the ram works the shell through a redraw die. The redraw process elongates the side walls of the can shell and decreases the side wall thickness and overall diameter of the can shell. The redraw operation is followed by two or three ironing stations that further elongate and thin the walls of the can shell to form a one piece can body. Finally, the body maker can be equipped with a doming station that further forms the enclosed bottom of the can body into a desired structural configuration. Typically, mechanical linkage is provided between the main crank shaft of the can body maker and both the ram assembly and the redraw assembly.

SUMMARY OF THE INVENTION

In a can body maker apparatus including ram means for the forming of a can body mounted for reciprocal motion within a can body maker frame, an improved drive system effects the reciprocal motion of the ram. The drive system comprises a crank having a first half and a second half, both being adapted for rotational movement about a first axis defined within the frame of the body maker. A brake disk means is fixedly mounted on the crank first half. A crank arm is mounted on the second half of the crank. The brake disk means and the crank arm define therebetween a second axis. A connecting rod is supported for rotational movement about the second axis. The connecting rod is in turn in mechanical communication with the ram means. A straight line motion assembly can be incorporated into the ram means so as to cooperate with the connecting rod in translating the rotational movement of the crank into the linear motion of the ram means.

The brake disk means and the crank arm define in combination at least an additional second axis, wherein the rotation of the crank arm about the additional second axis changes the throw of the connecting rod for each revolution of the drive system. The disk brake means includes a plurality of radially extending arms, each defining means for cooperating with the crank arm to define the position of the second axis relative to the first axis about which the crank rotates. The crank arm includes means defining a plurality of connecting means for cooperating with the disk brake means that define the position of the second axis relative to the first axis about which the crank rotates. The first half of the crank is in mechanical communication with a motor means. The connecting rod is in mechanical communication with the ram by means of a straight line motion assembly.

It is an object of this invention to provide an improved drive crank system for use in can body makers.

It is also an object of this invention to provide a crank system that facilitates the rapid change of rams and the rapid change of the crank connecting rod throw.

BRIEF DESCRIPTION OF THE DRAWINGS

The above as well as other features and advantages of the invention can be more fully appreciated through consideration of the detailed description of the invention in conjunction with the several drawings in which.

DETAILED DESCRIPTION OF A PREFERRED EMBODIMENT

Figure 1:
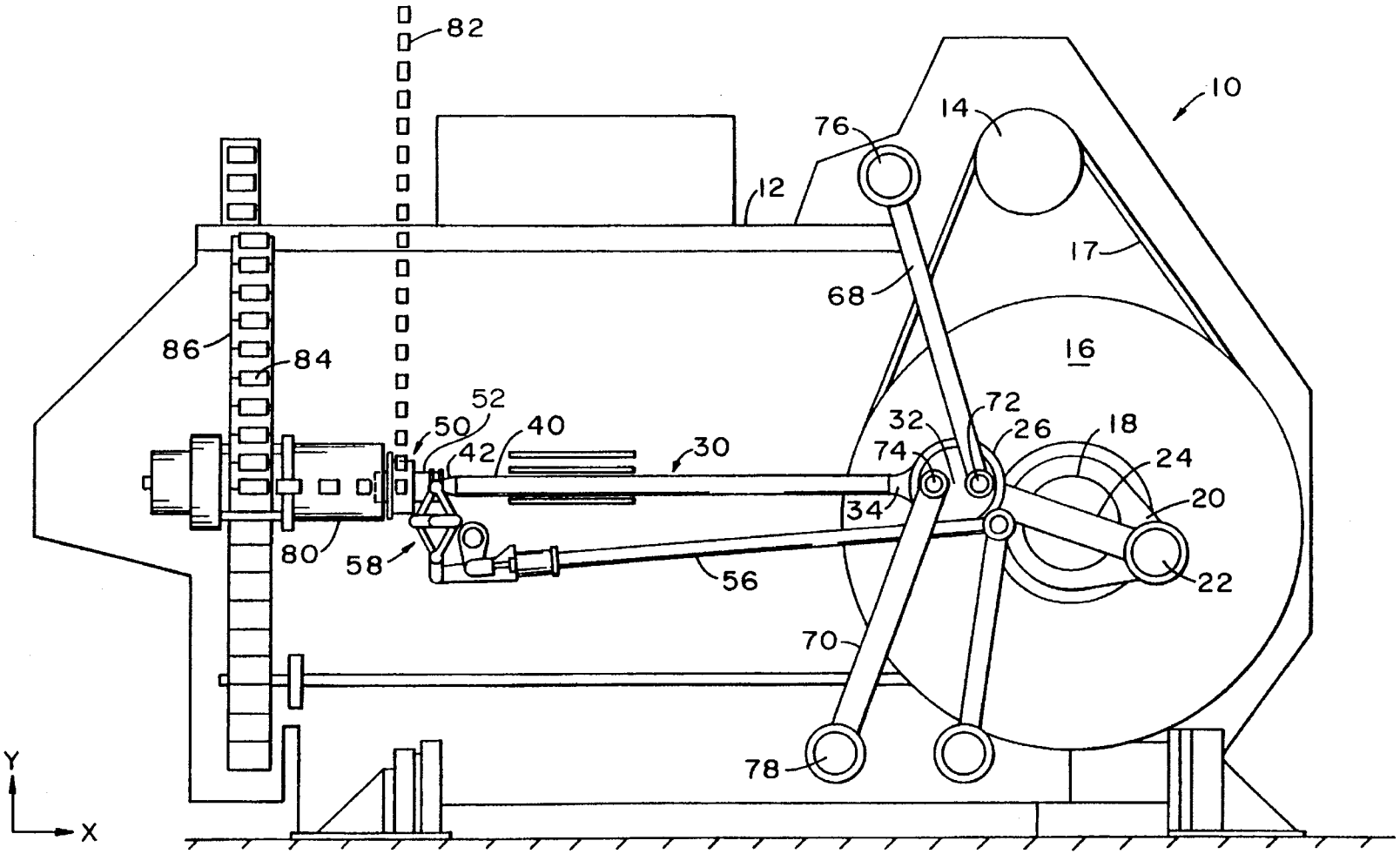
FIG. 1 (PRIOR ART)
FIG. 1 is an somewhat diagrammatic view of a prior art can body maker apparatus.

In order to fully appreciate the various aspects of this invention, it is useful to understand certain fundamental features of a typical can body maker apparatus. Turning now to FIG. 1, a can body maker illustrating a prior art ram main drive system is generally indicated by the reference character 10. The can body maker 10 includes a frame or housing structure 12 having mounted thereon a motor 14 that drives a large pulley wheel 16 by belt 17. The pulley wheel 16 is fixedly mounted on one of a pair of transversely extending axially aligned crankshafts 18 with crank arms 20. The crankshafts 18 are rotatable in bearings mounted in opposed sides of the frame 12. The crank arms 20 are connected together by a crank pin 22 extending through the bearings of a main connecting rod 24 which terminates at its other end in two parallel transversely spaced apart arms for engaging the circumferential surfaces of a cross head member 26, which is part of the straight line motion assembly generally designated by the reference character 40. The pivotal point of the assembly is designated 32. The cross head member 26 is engaged circumferentially by the end of a carriage connecting rod 34 by the connecting rod 24. The carriage connecting rod 34 is pivotably connected at its other end to a ram assembly 40, in which is mounted a ram or punch generally indicated at 42.

The ram or straight line motion assembly 40 includes a side thrust resisting, upper swing lever 68 and lower swing lever 70, both bifurcated at their inner ends so as to straddle the cross head member 26. The upper swing lever 68 is pivotably connected to the cross head member 26, as indicated at 72, and the lower swing lever 70 is pivotably connected at 74 to the cross head member 26. The upper end of the upper swing lever 68 is pivotably connected to the fixed pivots 76 on frame members 12, and the lower end of the lower swing lever 70 is pivotably connected to the fixed pivots 78 on frame members 12.

A redraw sleeve supporting assembly generally indicated at 50 is located adjacent a tool pack housing 80. A redraw sleeve 52 travels along an axis that is parallel to the ram 42 and movable in longitudinal or X axis motion independently of the ram. The tool pack housing 80, mounted in the front, or left hand portion of the can body maker as illustrated in FIG. 1, encloses a series of drawing and ironing dies (not shown) through which a work piece such as a shallow cup 82 is worked by the ram in combination with the redraw assembly 50. The cup 82 is drawn and ironed into a can body 84 and a suitable transport system 86 conveys the can body 84 from the body maker 10 for further processing. The redraw assembly 50 is located in front of the ram assembly 30 and next to the die housing assembly 80. The redraw assembly 50 performs the redraw operation and provides the alignment structure for the redraw sleeve 52. Generally, the redraw sleeve 52 aligns the metal cup 82 during the redraw operation and provides the correct pressure to the metal cup holding it against the redraw die face of the tool pack 80. The redraw sleeve is a component of the redraw assembly 50. The redraw sleeve is slidably mounted for reciprocal motion and is driven by means of a drive rod 56 and linkage 58. The redraw assembly and drive mechanism are described in detail in assignee's co-pending U.S. patent applications Ser. No. 171,232, "Improved Redraw Mechanism for Can Body Maker Apparatus"; and Ser. No. 174,232, "Improved Can Body Maker Apparatus with Flexible Redraw Sleeve".

Turning now to FIGS. 2 through 6, the improved can body maker of this invention is generally indicated by the reference character 110. The can body maker 110 includes a frame or housing structure 112 having mounted thereon a motor 114 that is in mechanical communication with one of a pair of transversely extending axially aligned crank shaft halves 116 and 118 that define in combination a first axis 119. Crank shaft half 116 is fitted with a brake disk 120. The second half 118 of the split crank shaft is equipped with a crank lobe or arm 122 having a predetermined length. The disk brake member 120 includes a plurality of radially extending arms 124 that terminate in the disk brake surface. Each of the extending arms 124 is provided with at least one aperture 126 that defines in combination with the crank lobe 122 a connecting point for supporting thereinbetween a connecting rod 128 by means of a supporting pin and bearing set generally defining a second axis indicated at 129.

The disk brake member 120 preferably includes four broad spokes or arms 124 radially extending from a central hub 121. Each spoke 124 includes at least one aperture 126. The aperture 126 of each spoke 124 is located at a predetermined distance from the hub and thus the first axis 119 about which the crank shaft halves 116 and 118 rotate. The location of the aperture 126 and thus its distance from the hub 121 defines the throw length of the connecting rod 128. Preferably, at least one of the apertures in each of the four spokes is located at a unique location to provide a selection of distinct throw lengths. For example, the center of the aperture 126 of a first spoke defines, in part, a second axis 129 that is 18.5 inches from the crank shaft axis, the aperture of the second spoke is 21.5 inches, the aperture of the third spoke is 24.5 inches, and the aperture of the forth spoke is located 26.5 inches from the axis of the crank shaft. Each of the predetermined dimensions is consistent with the desired throw length for the ram. The throw length is selected according to the dimensions of the can being drawn and ironed in the can body maker and the required forward motion of the ram (see FIG. 1). The crank lobe or arm 122 is of a predetermined length and includes an aperture 123 (see FIGS. *6a–6c*). In operation, the crank lobe aperture 123 cooperates with one of the apertures 126 of the disk brake to define the second axis 129 about which the connecting rod 128 rotates.

Figure 6B:
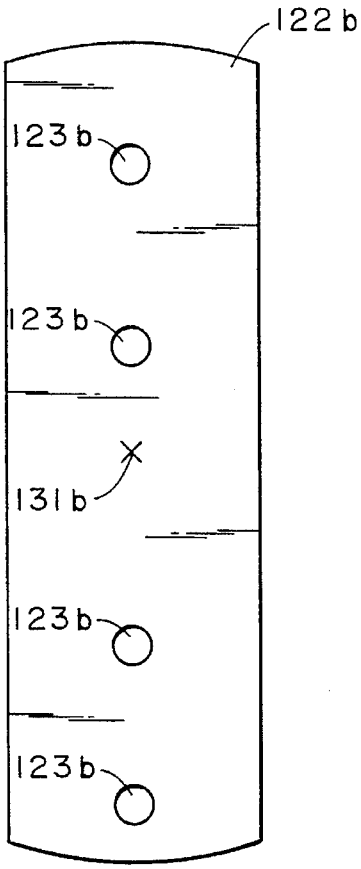
FIGS. 6A, 6B, and 6C are schematic illustrations of alternative embodiments of a crank lobe of the split crank shaft assembly of this invention.
Figure 6A:
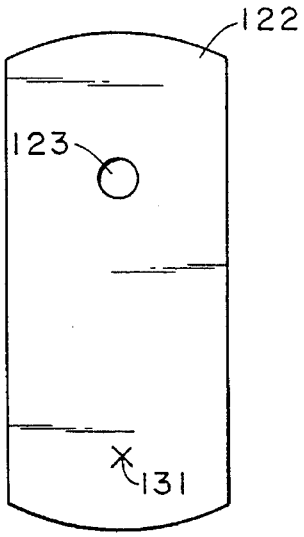
Figure 6C:
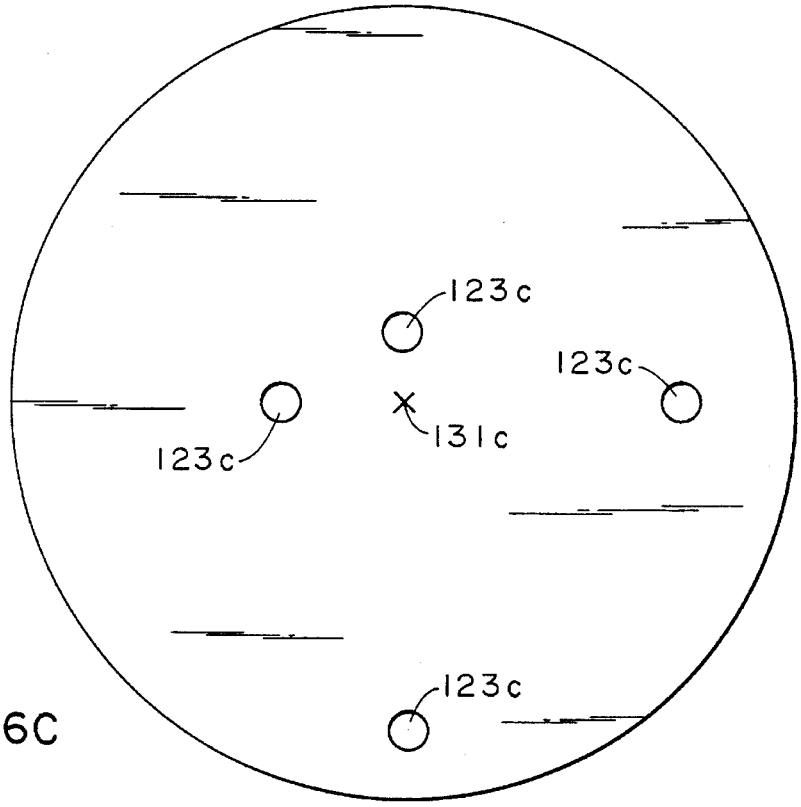

As can be seen in FIGS. 6A, 6B, and 6C, several embodiments of the crank lobe are illustrated. The preferred embodiment of FIG. 6A is shown in the several FIGS. 2 through 5. The crank lobe 122 has a first end 131 that is removably attached to the second crank shaft half 118. In a preferred embodiment, the body maker is provided with several, preferably four, individual crank lobes 122, each of which has the aperture 123 at a predetermined location. The several crank lobes are adapted to cooperate with the apertures 126 of the disk brake to support the several throw lengths described above. Therefore, each of the several crank lobes is at least long enough to support a crank lobe aperture in a predetermined position. Preferably, the several separate crank lobes 122 are of the same length in order to maintain the mass of the system as a constant value as the throw length is adjusted. The constant mass contributes to the overall balance of the system regardless of the selected crank lobe. Accordingly, adjustments to the counterbalance mass are made to compensate for changes to the lobe and stroke length. As should be appreciated, changes in the dimension of the can body height typically will require changes to the throw length of the ram. By physically changing the location of the second axis 129 about which the connecting rod 128 rotates in response to the rotation of the crank shaft halves 116 and 118, the throw length of the connecting rod, and therefore, the ram, is changed. The connection between the lob and crank hub preferably is a bolted pinned joint to facilitate the quick change out feature of the invention. Also, a bolted joint is provided between the lob and connecting rod pin as well as the brake disk and connecting rod pin. Current commercial practices dictate a body maker be able to change the throw length of the ram according to the range of dimensions set forth above, i.e., 18.5, 21.5, 24.5, and 26.5 inches. However, it is to be appreciated that future commercial requirements may require different throw lengths and the configuration of the instant invention is readily adaptable to such demands. The location of the apertures 126 of the disk brake and the dimensions of the crank arm, and therefore the location of the crank lobe aperture 123 can be modified to accommodate such further requirements. The preferred embodiment of several interchangeable crank lobes described above provides a body maker crank shaft characterized by quickly changeable, robust components.

In an alternative embodiment of FIG. 6B, a single, elongated crank lobe 122*b* with a plurality of apertures 123*b* can be employed in lieu of the current preferred use of several individual crank lobes, that are, in a manner of speaking, customized for installation to accommodate each given throw length. Likewise, in another alternative embodiment as shown in FIG. 6C, a disk like member 122*c* can be provided with several apertures 123*c* to accommodate each of the given throw lengths.

The connecting rod 128 is supported at a first end between the disk brake 120 and the crank lobe 122 for rotation about the second axis 129. The connecting rod 128 second end is in mechanical communication with the connecting link 130 of a straight line motion assembly, generally indicated by the reference character 132 by means of an appropriate bearing set. The straight line motion assembly 132 is operatively associated with the ram assembly 140. The ram assembly 140 includes a ram member 142 that is supported for longitudinal or X-axis motion in a fluid bearing 144. The ram 142 cooperates with the redraw sleeve in order to draw and iron the cup. As the crank shaft assembly (116 and 118) rotates about its Z-axis, the connecting rod 28 by means of the straight line motion assembly draws the ram 142 rearwardly and then drives it forwardly to complete the drawing and ironing operations. The redraw assembly and tool pack function as previously described in connection with FIG. 1 body maker for further processing.

Both the high speed and the extremely thin gage of the drawn and ironed can require that the ram movement be maintained within a narrow band of tolerance. Unnecessary and undesired vibration can damage the work piece, the tooling and ultimately the body maker. As can be appreciated from the description of the conventional body maker drive mechanism of FIG. 1, a complex, and rather large structure has been employed to minimize the undesired and potentially destructive excursions of the ram in the Y and Z axis of the mechanism. The improved drive crank shaft mechanism described herein provides rotational motion that is translated into the nonlinear, reciprocating motion of the connecting rod 128. This reciprocating motion of the connecting rod 128 is translated into the linear motion of the ram assembly 142 by means of a straight line motion assembly 132 or the ram guidance linkage.

Figure 2:
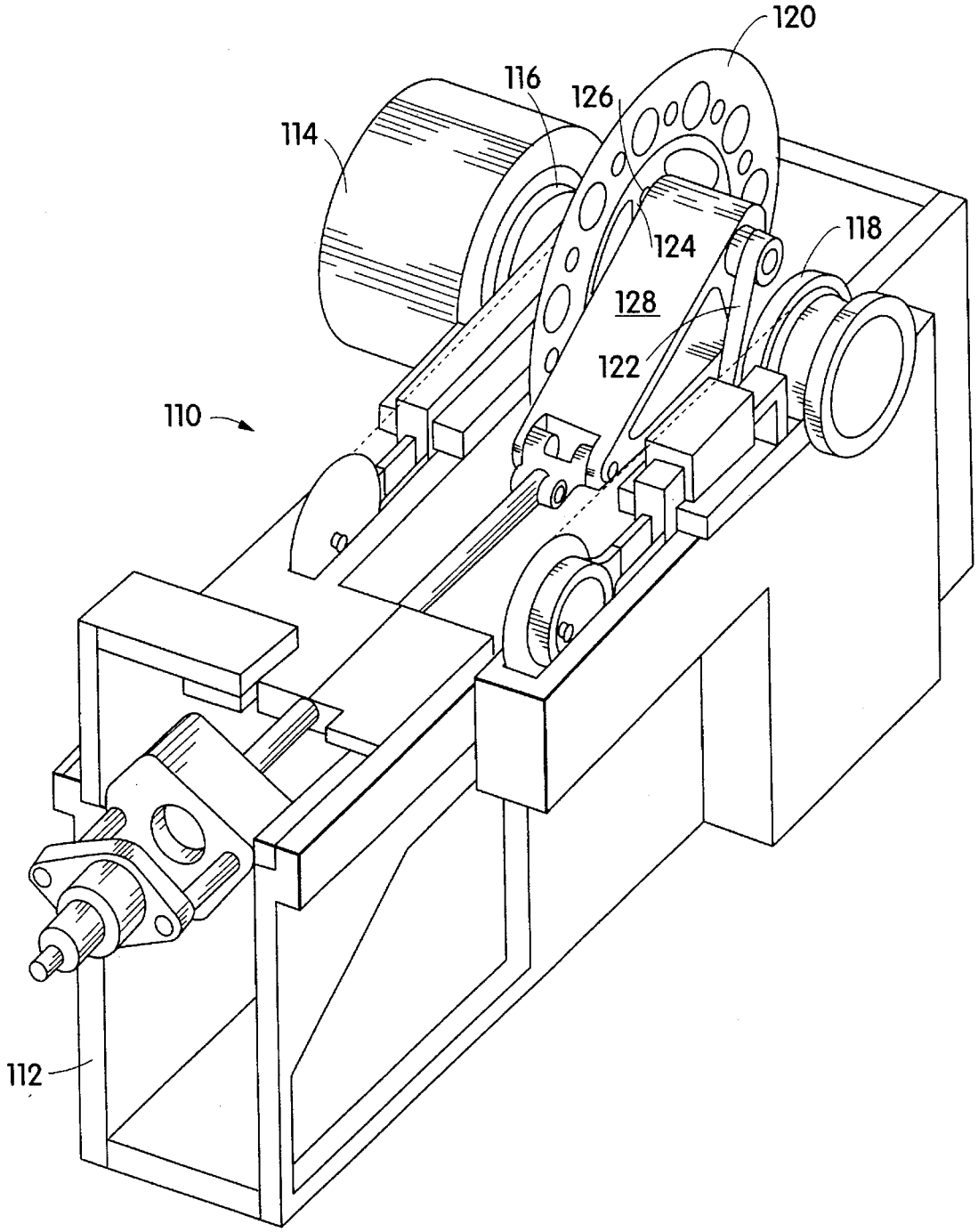
FIG. 2 a schematic view of a partial view of the improved can body apparatus of this invention, with sections removed, incorporating one embodiment of a counterbalance mass system of the present invention.
Figure 3:
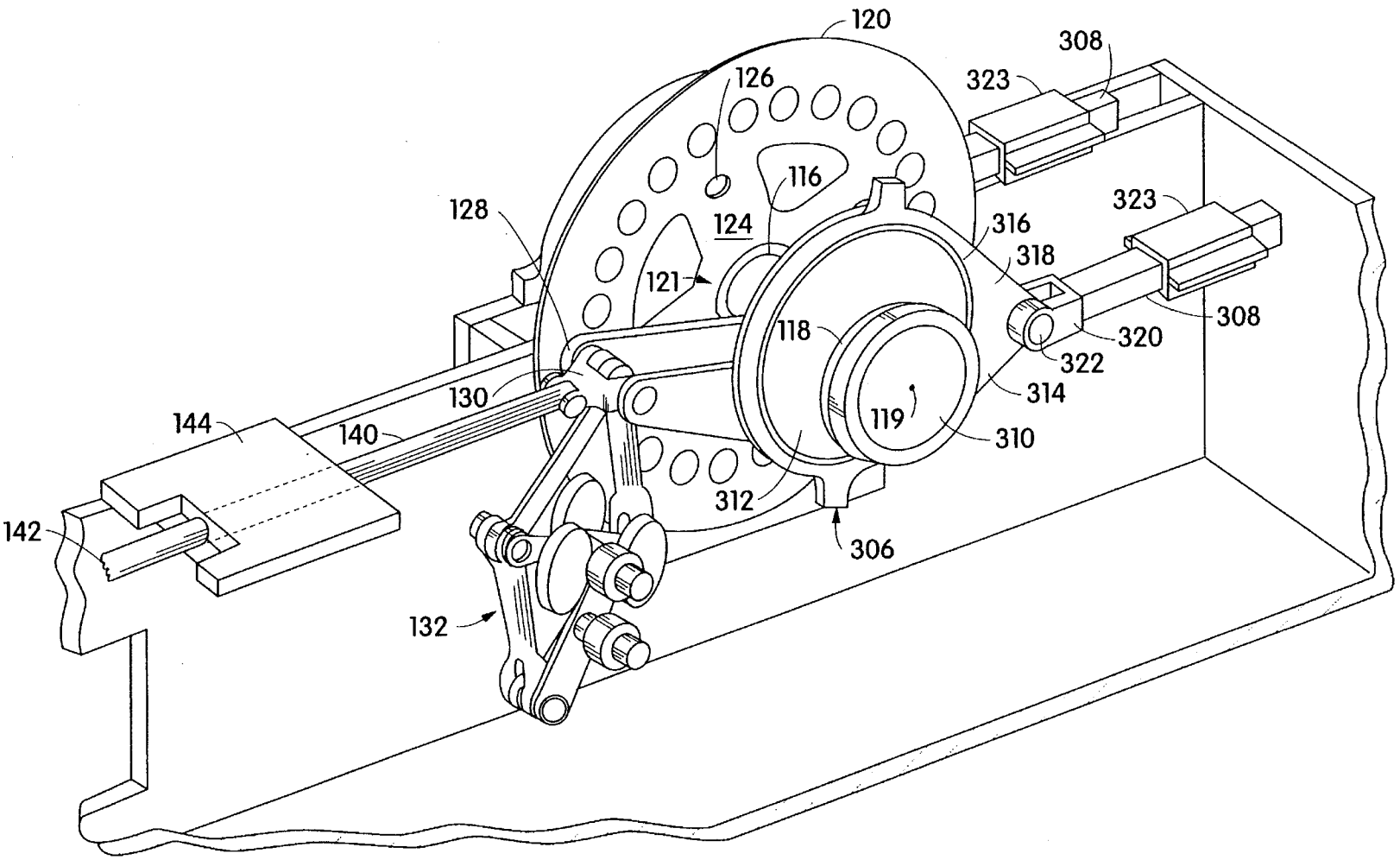
FIG. 3 is a schematic view of a preferred embodiment of the counterbalance mass system with sections cut away.
Figure 4:
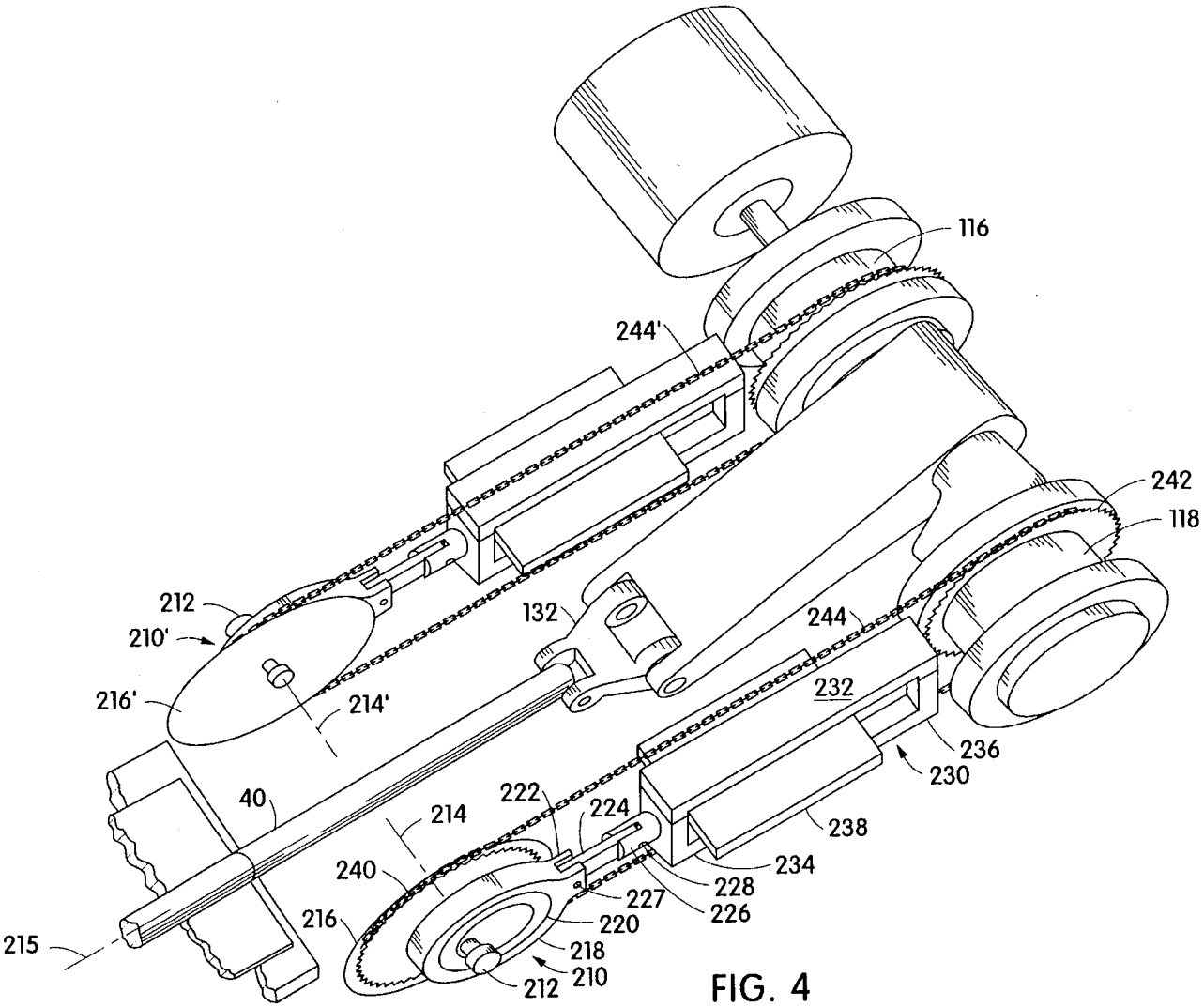
FIG. 4 is a schematic view illustrating the primary components of the counterbalance mass system of the alternative embodiment of FIG. 2.
Figure 5:
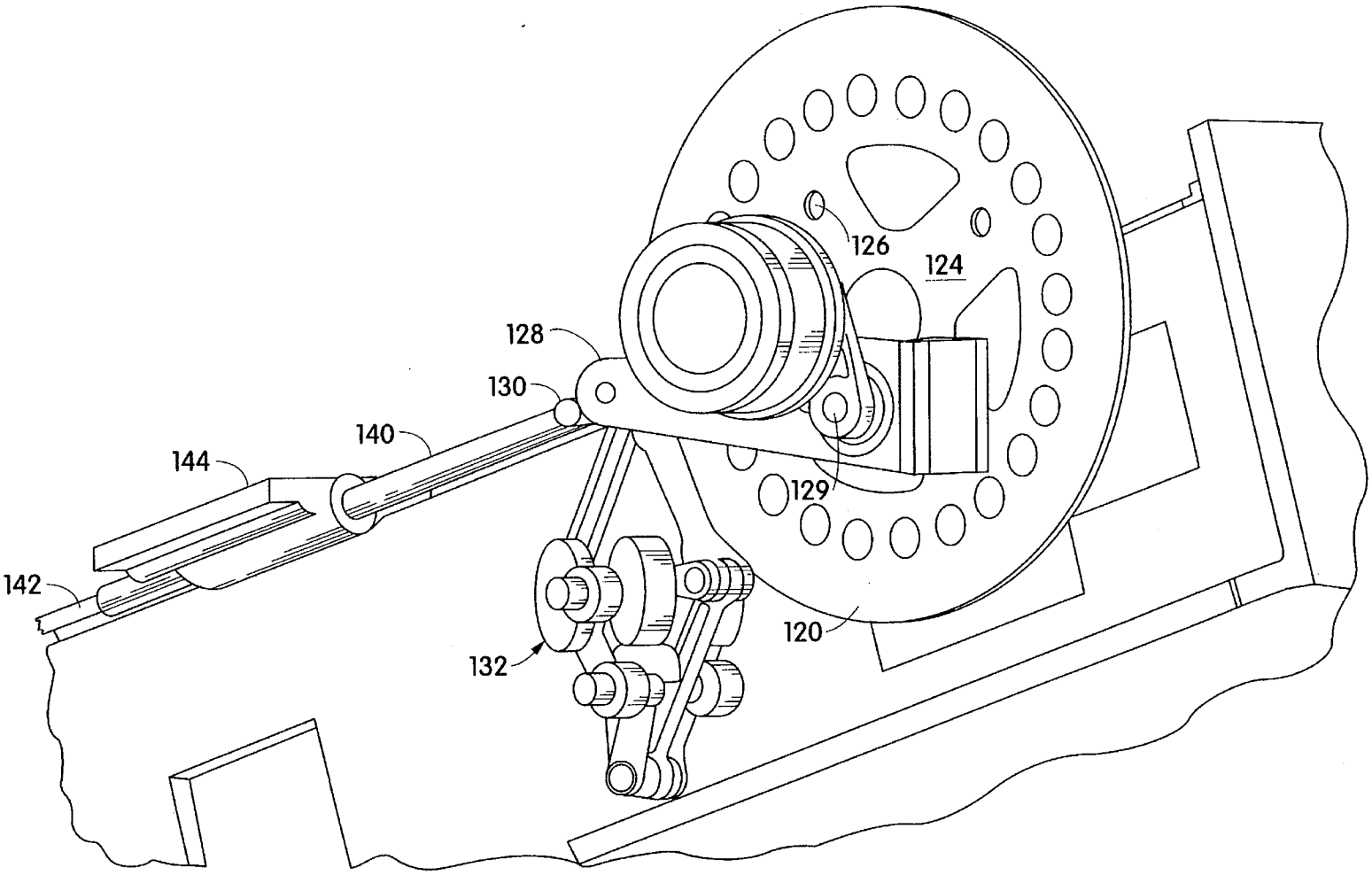
FIG. 5 is a schematic view of the split crank shaft assembly with the left side counterbalance mass system cut away.

Considering FIGS. 2, 3, and 4, there is shown two embodiments of the improved counterbalance mass apparatus according to this invention. In the embodiment of FIGS. 2 and 4, each of the crankshaft halves 116 and 118 is in mechanical communication with counterbalance mass means generally indicated by the reference characters 210 and 210'. It is to be appreciated that looking forward from the rear of the can body maker toward the die pack, the left and right counterbalance mass means 210 and 210', respectively, are substantially identical in configuration. Accordingly, only one half, the left half, of the can body maker counterbalance mass system will be described in detail. It is to be understood that like components of the right half of the counterbalance mass system are referenced by designating characters distinguished with the prime (') symbol. A preferred embodiment of the counterbalance mass system is described below in connection with FIG. 4.

In FIG. 4 the left side counterbalance mass system 210 includes a shaft member 212 supported by frame 112 of the can maker body. A supporting shaft member 212 defines a first axis 214 that is normal to the X-axis 215 defined by the ram member 40. A counterbalance drive member or wheel 216 is mounted for rotation on axis 212. A cam member 218 is mounted for eccentric rotation on the drive wheel 216 relative to the first axis 214. The cam member 218 is supported for said rotation movement by means of a bearing set generally indicated at reference character 220. The cam 218 includes a lobe portion 222 which provides an attachment point to a connecting link 224. The connecting link 224 is connected at the first end by means of a pivot point 227 to the cam lobe 222 and at its second or opposite end to the support shaft 226 at pivot 228.

The mass member generally indicated by the reference character 230 includes an upper half 232 and a lower half 234. A generally centrally located shaft 236 supports the two halves 232 and 234 of the counterbalance mass 230. The shaft 236 is adapted to be supported in a bearing housing which can be, for example, a fluid bearing or a bearing material, and is generally indicated at the reference character 238. The bearing housing 238 is fixedly supported to the frame 112 of the body maker. The rod 236 is connected mechanically as described before to the link 224. As the drive wheel 216 rotates about its axis 212, the eccentric motion of the cam member 218 relative to the axis 214 creates the reciprocal motion of the shaft or counterbalance support member 236. The support member 236 reciprocates, supported within the bearing housing 238. The upper and lower halves 232 and 234 of the counterbalance mass 230 are fixedly attached by means of bolting or the like to the shaft 236. Thus, as the shaft 236 reciprocates within the fluid bearing, the counterbalance mass 230 is caused to reciprocate parallel to the x-axis defined by the ram.

The drive wheel 216 is in mechanical communication with the crankshaft half on the same side of the body maker. In this embodiment, this communication is affected by means of a chain extending around a geared portion 240 of the drive wheel and a geared portion 242 of the crankshaft half. A continuous chain 244 transmits the rotational movement of the crankshaft to the drive wheel 216. As the crankshaft rotates, the drive wheel rotates and in turn causing the counterbalance mass member to reciprocate. By providing a pair of identical counterbalance mass systems on opposite sides of the can body maker ram, the total mass required for each of the individual counterbalance systems is reduced and there is no torsional imbalance. Moreover, the total throw of the counterbalance mass can be shortened relative to the throw of the ram as long as the basic equation "F=MA" is observed. Thus, there are literally an infinite number of combinations possible in the total throw length, acceleration, and counterbalance mass that can be joined to provide an appropriate balance to the action of the ram.

Turning to FIG. 3, there is shown a preferred embodiment of the counterbalance mass system in which the mass members 308 are mounted to the rear of the crank shaft. The reciprocal movement of the mass members is effected by means of a direct mechanical connection with the crank shaft halves. While only portions of the right side of the counterbalance mass system are shown, it is to be appreciated that the right side is substantially identical to the left side described with reference to FIG. 3. Specifically, there is mounted on each of the crank halves, 116 and 118, a counterbalance drive means generally indicated at 306 and consisting of a crank hub 310 that defines the first axis about which the cam member 312 is mounted for eccentric rotation about the first axis. A cam member 314 is mounted for eccentric rotation relative to the first axis in order to impart reciprocal motion to the counterbalance mass members 308. The cam member 314 is supported for rotational movement by means of a bearing set generally indicated at reference character 316. The cam member 314 includes a lobe portion 318 that provides an attachment point to a connecting link 320. The connecting link 320 is connected at the first end by means of a pivot point 322 to the cam lobe 318 and at its second or opposite end to the counter balance mass 308.

In operation, as the hub 310 causes the eccentric 312 to rotate about the first axis 119, the cam member 314 with lobe portion 318 reciprocates parallel to the X axis of the can body maker as that X axis is defined by the motion of the ram member 142. The reciprocating motion of the cam lobe portion 318 effects the reciprocal motion of the mass members 308. In this preferred embodiment, the mass members 308 are supported within housing 323. The housing 323 includes a lining consisting of a low friction, bearing material. It is to be appreciated that components of the alternative embodiment, forwardly disposed, counterbalance mass structure, such as the fluid bearing arrangement can be incorporated into the rearwardly disposed counterbalance mass system of FIG. 3.

As can be appreciated, when the throw length of the ram is modified to accommodate the manufacturer of can bodies of different length, the counterbalance system can readily be modified to maintain optimum can body maker performance by adjusting the mass members.

The present invention has been described in an illustrative manner. It is to be understood that the terminology which has been used is intended to be in the nature of words of descriptive rather than limitation. Many modifications and variations of the preset invention are possible in light of the above teachings. Therefore within the scope of the appended claims, the present invention may be practiced otherwise than as specifically described.

What is claimed is:

1. In combination with a can body maker apparatus including ram means for the forming of a can body mounted for reciprocal motion within a can body maker frame, an improved drive system for effecting the reciprocal motion of the ram, said drive system comprising a crank having a first half and a second half, both being adapted for rotational movement about a first axis; a brake disk means fixedly mounted on said first half, a crank arm mounted on said second half, said brake disk means and said crank arm defining therebetween a second axis; whereby said brake disk means and said crank arm are adapted to support therebetween a connecting rod rotatable about said second axis and in mechanical communication with the ram means.

2. The improved drive system according to claim 1 wherein the brake disk means and the crank arm define in combination at least one additional second axis, wherein the rotation of the crank arm about said additional second axis changes the throw of the connecting rod for each revolution of the drive system.

3. The improved drive system according to claim 1 wherein the disk brake means includes a plurality of radially extending spokes, each defining means for cooperating with the crank arm to define the position of the second axis relative to the first axis about which the crank rotates.

4. The improved drive system according to claim 3 wherein the crank arm includes means defining a plurality of means for cooperating with the disk brake means to define the position of the second axis relative to the first axis about which the crank rotates.

5. The improved drive system according to claim 1 wherein the first half of the crank is in mechanical communication with a motor means.

6. The improved drive system according to claim 1 wherein the connecting rod is in mechanical communication with the ram be means of a straight line motion assembly.

7. A can body maker apparatus main drive system for reciprocating a ram means comprising a crank having a first half and a second half, both being adapted for rotational movement about a first axis in the can body maker apparatus; a brake disk means fixedly mounted on said crank first half, a crank arm mounted on said crank second half, said brake disk means and said crank arm defining therebetween a second axis; a connecting rod supported for rotational movement about said second axis, said connecting rod being adapted for mechanical communication with the ram means.

8. The main drive system according to claim 7 wherein the brake disk means and the crank arm define in combination at least one additional second axis, wherein the rotation of the crank arm about said additional second axis changes the throw of the connecting rod for each revolution of the drive system.

9. The main drive system according to claim 7 wherein the disk brake means includes a plurality of radially extending spokes, each defining means for cooperating with the crank arm to define the position of the second axis relative to the first axis about which the crank rotates.

10. The main drive system according to claim 7 wherein the crank arm includes means defining a plurality of means for cooperating with the disk brake means to define the position of the second axis relative to the first axis about which the crank rotates.

11. The main drive system according to claim 7 wherein the first half of the crank is adapted to be in mechanical communication with a motor means.

12. An improved drive system adapted for use in a can body maker in order to effect the reciprocal motion of a ram, said drive system comprising a crank having a first half and a second half, both being adapted for rotational movement about a first axis; a brake disk means fixedly mounted on said first half, a crank arm mounted on said second half, said brake disk means and said crank arm defining therebetween a second axis; whereby said brake disk means and said crank arm are adapted to support therebetween a connecting rod rotatable about said second axis and in mechanical communication with the ram means.

13. The improved drive system according to claim 12 wherein the brake disk means and the crank arm define in combination at least one additional second axis, wherein the rotation of the crank arm about said additional second axis changes the throw of the connecting rod for each revolution of the drive system.

14. The improved drive system according to claim 12 wherein the disk brake means includes a plurality of radially extending spokes, each defining means for cooperating with the crank arm to define the position of the second axis relative to the first axis about which the crank rotates.

15. The improved drive system according to claim 14 wherein the crank arm includes means defining a plurality of means for cooperating with the disk brake means to define the position of the second axis relative to the first axis about which the crank rotates.

16. The improved drive system according to claim 12 wherein the first half of the crank is in mechanical communication with a motor means.

17. The improved drive system according to claim 12 wherein the connecting rod is in mechanical communication with the ram be means of a straight line motion assembly.

* * * * *